US005258079A

United States Patent [19]

Nakatsukasa et al.

[11] Patent Number: 5,258,079

[45] Date of Patent: Nov. 2, 1993

[54] METHOD AND TREATING SOLUTION FOR PHOSPHATING METAL SURFACES

[75] Inventors: Mikio Nakatsukasa; Naoharu Miyazaki, both of Hiroshima; Yuichi Yoshida, Kyoto, all of Japan

[73] Assignee: Mazda Co., Ltd., Osaka, Japan

[21] Appl. No.: 658,607

[22] Filed: Feb. 21, 1991

[30] Foreign Application Priority Data

Mar. 16, 1990 [JP] Japan ..... 2-67989

[51] Int. Cl.[5] ..... C23C 22/12

[52] U.S. Cl. ..... 148/262

[58] Field of Search ..... 148/262

[56] References Cited

U.S. PATENT DOCUMENTS

| | | | |
|---|---|---|---|
| 1,324,460 | 7/1973 | Heller | 148/262 |
| 4,717,431 | 1/1988 | Kanaster | 148/262 |
| 4,849,031 | 7/1989 | Hauffe | 148/262 |
| 5,082,511 | 1/1992 | Faring | 148/262 |

FOREIGN PATENT DOCUMENTS

| | | | |
|---|---|---|---|
| 0763628 | 4/1971 | Belgium | 148/262 |
| 0204888 | 10/1985 | Japan | 148/262 |

OTHER PUBLICATIONS

EP0228151-Jul. 1987.
EP0381190 Aug. 1990.

*Primary Examiner*—Sam Silverberg
*Attorney, Agent, or Firm*—Lowe, Price, LeBlanc & Becker

[57] ABSTRACT

The present invention relates to a phosphating method and solution for forming on a metal surface a phosphate film, which are used for elevating coating finish and rust-preventive property when a product consisting essentially of steel and/or zinc-plated steel combined with an aluminum alloy is coated with cationic electrocoating.

The method and solution comprise that said metal surface is brought, to form a coating film, in contact with an aqueous phosphate solution which satisfies the following conditions with respect to the six kinds of ions contained. A total concentration of a sodium ion and a potassium ion is in a range of 2.0 to 15.0 (g/l). A total concentration of a manganese ion and a nickel ion is in a range of 1.0 to 5.0 (g/l). Concentration of a zinc ion is in a range of (1.6−0.02 T) to (2.5−0.02 T) (g/l). Concentration of a free $F^-$ ion is in a range of 8.0 $T^{-1}$ to 20.0 $T^{-1}$ (g/l), (here, T is temperature (°C.) of a phosphating solution and in a range of 20 to 60).

Contact of the metal surface with the phosphate solution is carried out with a combined process of dipping treatment subsequently followed by spraying treatment.

4 Claims, No Drawings

METHOD AND TREATING SOLUTION FOR PHOSPHATING METAL SURFACES

BACKGROUND OF THE INVENTION

The present invention relates to a method and a treating solution for phosphating metal surfaces (hereinafter, the term "a phosphating method and solution" is used for this method and solution, respectively.) and, in detail, when a product consisting of steel and/or zinc-plated steel combined with an aluminum alloy is coated with cationic electrocoating, with an attempt for elevating the coating finish and rust-preventive property, the present invention relates to a phosphating method for forming on a metal surface a phosphate film, of which fundamental component is zinc phosphate, and also to a phosphating solution which is used for said phosphating method.

It is so far widely known that, by phosphating a metal surface, a film which is appropriate as an under coating for cationic coating is made.

Although steel and zinc-plated steel are common as the metal material, in recent years a product consisting of combination of steel and/or zinc-plated steel with an aluminum alloy are becoming available. For example, although the automobile bodies all have been so far made of steel plates, an attempt to replace a part of the bodies with an aluminum product has been carried out. Also, in replacement of the steel plates, a zinc-plated steel plate is in an increasing use and also, use of a zinc-plated steel plate combined with an aluminum alloy is increasing. Thus, has been desired a phosphating method capable of simultaneous treating of a metal surface consisting of the steel and/or zinc-plated steel combined with an aluminum alloy.

There have been proposed various conditions for a method and solution for phosphating the steel and zinc-plated steel, under which the coating finish, adhesion, and rust-preventive property etc. are elevated, and for example, which are opened in Japanese Official Patent Provisional Publications, showa 57-152472 and 59-35681.

However, in these kinds of phosphating methods for steel and zinc-plated steel, when the steel and/or zinc-plated steel are simultaneously treated with an aluminum alloy, an aluminum ion elude the aluminum alloy and accumulate in a treating bath, and the phosphate film on the surfaces of steel and zinc-plated steel is not normally made owing to the accumulated aluminum ion. Also, an uniform film is not made on the surface of an aluminum alloy.

In order to solve the above-mentioned problems, there has been proposed a method in which, to prevent the elusion of an aluminum ion into the phosphating solution, converting treatment of the aluminum alloy into a passive state such as the chromating is beforehand carried out in a separate process and the steel or zinc-plated steel is simultaneously with an aluminum alloy treated with phosphating, and which is opened in Japanese Official Patent Provisional Publication, showa 61-96074. However, this method needs a converting process of an aluminum alloy into a passive state in addition of the phosphating process and also, properties which are satisfactory as an under coating for cationic coating have not been displayed on the surfaces of steel and zinc-plated steel as well as on the surface of an aluminum alloy.

Furthermore, there have been proposed phosphating methods in which phosphating solutions containing a fluorinated compound are used, and which are opened in Japanese Official Patent Provisional Publications, showa 63-15789 and 64-68481.

SUMMARY OF THE INVENTION

However, in the forementioned so far-known arts an uniform and good phosphate film can not be formed on the metal surface of either or all of steel, zinc-plated steel, and an aluminum alloy, so that properties which are satisfactory as an under coating for the cationic coating can not been displayed.

Practically, in a case of that a structure consisting of steel and zinc-plated steel as well as an aluminum alloy is treated with a phosphating solution in which zinc phosphate is a main component, if the eluded aluminum ion accumulate in a concentration of 5 ppm or more in a phosphating solution not containing a fluorine ion, badness in converting a steel material occurs. Also, in a phosphating solution containing a boron fluoride derivative or a silicon fluoride derivative which is called as a fluoride complex, if the aluminum ion accumulate in a concentration of 100 to 300 ppm against 1000 ppm of the fluoride complex, occurrence of badness in converting a steel material similarly is found.

Accordingly, a subject of the present invention is to provide, in the phosphating method as described above, a method in which a superior and uniform zinc phosphate film can be made on all the surfaces of steel, zinc-plated steel, and an aluminum alloy and, in particular, scattering in quality and properties arising from variation of phosphating conditions is hard to occur and the stable finish is easily obtained. Also, another subject is to provide a phosphating solution which is used for said method.

In the method in which a metal surface consisting essentially of steel and/or zinc-plated steel combined with an aluminum alloy is treated with a phosphating solution before the cationic electrocoating, an phosphating method proposed here for solving said subjects in the present invention involves conversion into a film by bringing said metal surface in contact with an aqueous phosphating solution which satisfies the undermentioned four conditions.

(a) $2.0 \leqq \text{Na ion} + \text{K ion} \leqq 15.0$ (g/l)

That is, a total concentration of a sodium ion and a potassium ion is in a range of 2.0 to 15.0 (g/l).

(b) $1.0 \leqq \text{Mn ion} + \text{Ni ion} \leqq 5.0$ (g/l)

That is, a total concentration of a manganese ion and a nickel ion is in a range of 1.0 to 5.0 (g/l).

(c) $1.6 - 0.02\,T \leqq \text{Zn ion} \leqq 2.5 - 0.02\,T$ (g/l)

That is, a concentration of a zinc ion is in a range of $(1.6 - 0.02\,T)$ to $(2.5 - 0.02\,T)$ (g/l).

(d) $8.0\,T^{-1} \leqq \text{free } F^- \text{ ion} \leqq 20.0\,T^{-1}$ (g/l)

That is, a concentration of a free $F^-$ ion is in a range of $8.0\,T^{-1}$ to $20.0\,T^{-1}$ (g/l).

[Here, T is a temperature (°C.) of a phosphating solution, and $20 \leqq T \leqq 60$.]

In a case of that a phosphate film having zinc phosphate as a fundamental component is forming on a surface of the aluminum alloy, etching on the aluminum surface due to a fluorine ion is rate-limiting and uniformity of the forming phosphate film is determined by an amount of the fluorine ion in a phosphating solution and, in particular, by the free fluorine ion (free $F^-$ ion) which is not a complex ion, that is, by concentration of an active fluorine ion. However, a rate and an amount of the etching reaction by the fluorine ion on an aluminum surface are greatly affected by temperature of a phosphating solution, so that a suitable concentration of the free $F^-$ ion must be determined considering the temperature condition.

Therefore, in the present invention the concentration of the free $F^-$ ion must be strictly adjusted against the phosphating temperature so as to be in a range of 8.0 $T^{-1}$ to 20.0 $T^{-1}$ (g/l), wherein T is temperature (°C.) of a phosphating solution and in a range of 20 to 60.

In a case of that the free $F^-$ ion is less than the lower limit of the indicated range, formation of the phosphate film on a surface of the aluminum alloy becomes insufficient, so that defined coating performance is not obtained. Also, in a case of that the free $F^-$ ion is over the upper limit of the range, the phosphating reaction proceeds too fast in rate and, as a result, sodium and/or potassium salts of the aluminum come and mix into a coating film which may originate badness in a coating film skin or may originate bad adhesion of a coating film. Besides, as the temperature becomes higher, the reaction by the free $F^-$ ion proceeds so actively and, as a result, both the upper and lower limits of the forementioned appropriate concentration range become lower.

The aluminum ion which eluded the aluminum alloy during the phosphating are led to formation of a complex ion by being combined with the free $F^-$ ion in the phosphating solution, so that the free $F^-$ ion concentration decreases as the phosphating proceeds. Thus, in the phosphating solution a supplying source of the free $F^-$ ion for maintaining the free $F^-$ ion in said concentration range is necessary. As a supplying source of the free $F^-$ ion can be used any optional compound capable of supplying the free $F^-$ ion and, in particular, one or more kinds of compounds selected from a group consisting of hydrofluoric acid, potassium fluoride, sodium fluoride, acid potassium fluoride, acid sodium fluoride, ammonium fluoride, and acid ammonium fluoride are preferred for use.

The aluminum ion which have been converted into a complex with the free $F^-$ ion transform into an insoluble form in presence of a sodium ion and/or a potassium ion with formation of $Na_3AlF_6$, $K_3AlF_6$, $NaK_2AlF_6$, and $(K \text{ or } Na)_3AlF_6$ etc.

The total amount of both a sodium ion and a potassium ion necessary for a reaction for converting the aluminum ion into the insoluble form is in a concentration range of 2.0 to 15.0 (g/l) and, unless it is properly controlled within this range, the reaction between said free $F^-$ ion and the aluminum ion does not properly proceed.

Also, to form on a metal surface a phosphate coating film in which zinc phosphate is a fundamental component, control of the zinc ion concentration in a phosphating solution is important and a reaction by this zinc ion for forming the phosphate coating film is greatly affected by temperature. Therefore, in the present invention the zinc ion concentration must be strictly controlled in a range of (1.6−0.02 T) to (2.5−0.02 T) (g/l).

If the zinc ion concentration is lower than the lower limit of the range, an uniform coating film is not made on the aluminum alloy and steel by a conversion reaction. Also, if the zinc ion concentration is over the upper limit of the range, an under coating film suitable for cationic electrocoating is hard to be formed on all the surfaces of steel, zinc-plated steel, and an aluminum alloy. Regarding the zinc ion concentration, as the temperature of a phosphating solution becomes higher, the formation reaction of a phosphate coating film proceeds very actively and, as a result, both the upper and lower limits of the forementioned appropriate concentration range become lower.

Furthermore, to elevate the water-resistant adhesion of a coating film for an aluminum alloy and zinc-plated steel in cationic electrocoating, a manganese ion or a nickel ion is effective. Therefore, in the present invention a total concentration of both the manganese ion and nickel ion is set in a range of 1.0 to 5.0 (g/l).

To the phosphating solution may be added a usual accelerator for forming a coating film with conversion. As a practical accelerator and its adding amount for this formation of a coating film is preferred one or more kinds selected from a group consisting of a nitrite ion in a concentration range of 0.01 to 0.2 (g/l), a nitrate ion in a concentration range of 1 to 10 (g/l), a nitrobenzenesulfonate ion in a concentration range of 0.05 to 2.0 (g/l), a chlorate ion in a concentration range of 0.05 to 5.0 (g/l), and hydrogen peroxide in a concentration range of 0.05 to 2.0 (g/l).

Practical working procedure and conditions for the phosphating may be carried out similarly to a case of common phosphating treatment. In the method in this invention said temperature of a phosphating solution (T) is capable of freely setting in a range of 20° to 60° C. As a means for bringing a metal surface in contact with a phosphating solution, a phosphating means which is similar to common phosphating treatment can be applied and, more practically, dipping treatment and spraying treatment may be used. For example, if dipping treatment for 15 or more seconds immediately followed by spraying treatment for 2 or more seconds is carried out in combination, an uniform and superior phosphate film is effectively formed.

Although, in previous phosphating methods, setting of the concentration range of each ion being contained has been carried out so as to be within defined upper and lower limits, in the present invention by considering the temperature conditions which give great influence on results of the phosphating, the problem of scattering of phosphating performance and instability of finishing quality were solved.

That is, the most important factor in phosphating an aluminum alloy is an etching reaction by the fluorine ion on the aluminum alloy surface and a reaction for converting the aluminum ion into an insoluble form, wherein the aluminum ion eluded into a phosphating solution by the etching combines with the fluorine ion.

Accordingly, in the present invention, setting of the most appropriate concentration range of a free $F^-$ ion becomes always possible, under a condition of practical phosphating temperature, by that a concentration range of the active fluorine ion participating in the reaction, that is, a concentration range of the free $F^-$ ion is strictly set by considering temperature conditions of a phosphating solution. As a result, simple and prompt control of the phosphating solution is possible and the phosphating can be always performed under an appropriate condition, even in a site of practical production and in a working line etc. where the phosphating is performed under various temperature conditions arising from variation of working circumstances and working conditions.

According to the forementioned method for phosphating metal surfaces relating to the present invention, an uniform and superior phosphate coating film can be made on all surfaces of steel, zinc-plated steel, and an aluminum alloy by strictly controlling a concentration of the free $F^-$ ion which plays a very important role for phosphating the surface of an aluminum alloy. Moreover, since a concentration range of the free $F^-$ ion is adjusted according to the phosphating temperature with consideration of that an activity of the free $F^-$ ion or a driving force for reaction differ with temperature, even if the temperature conditions vary with difference of circumstances and working processes, an appropriate concentration of the $F^-$ ion can be maintained. Therefore, even in a producing line etc. in which the temperature conditions easily vary, an appropriate phosphating method can be simply and promptly applied, and stability and reliability in quality of the phosphating may be greatly evaluated.

Also, a fact that the concentration ranges of not only the free $F^-$ ion, but also the zinc ion, sodium ion, potassium ion, manganese ion, and nickel ion etc. are properly set may greatly contribute, together with the concentration control of said free $F^-$ ion, for high performance of a whole phosphating process and stabilization of quality.

DESCRIPTION OF THE PREFERRED EMBODIMENTS

Concrete explanation of the present invention is given with referring to examples and examples for comparison.

PLATE BEING SUBJECTED TO COATING

Cold rolled steel plate . . . JIS-G-3141

Zinc-plated steel plate . . . Steel plates electroplated with a zinc and nickel alloy Aluminum alloy . . . an alloy of an aluminum and magnesium Plates being subjected to coating which are consisting of combination of the above three kinds of metals were rinsed, to clean the surfaces of metal material, with an alkaline degreasing agent whose main component was sodium phosphate and then, with water and, furthermore, the surfaces of the plates were conditioned with an aqueous titanium salt solution. Next, under the conditions explained below were carried out the phosphating, rinsing with water followed by with deionized water, then cationic electrocoating, and intermediate coating followed by top coating, and performance of the plates thus-obtained was compared.

SURFACE-TREATING PROCESS (1) Degreasing

In an aqueous 2.0% by weight solution of an alkaline degreasing agent made by Nippon Paint Co., Ltd. (Surf cleaner SD 270 TO) were dipped the plates being subject to coating at 40° C. for 2 minutes, to carry out degreasing.

(2) Water Rinsing

Rinsing was carried out with tap water at room temperature for 30 seconds.

(3) Surface Conditioning

Using an aqueous 0.1% by weight solution of a surface conditioning agent made by Nippon Paint Co., Ltd. (Surf fine 5 MZ), dipping treatment was carried out at room temperature for 15 seconds.

(4) Phosphating

Dipping treatment was carried out for 2 minutes under the conditions described in Tables 1 and 2 presented below. Table 1 shows the examples in the present invention and Table 2 shows the examples for comparison.

Besides, among the examples for comparison, the example for comparison 1 is a case of that the free $F^-$ ion is not contained, the example for comparison 2 is a case of that the total amount of a sodium ion and a potassium ion is small, the examples for comparison 3 and 12 are cases of that the total amount of a sodium ion and a potassium ion is large, the examples for comparison 4 and 10 are cases of that the amount of a free $F^-$ ion is large, the example for comparison 5 is a case of that the total amount of a manganese ion and a nickel ion is small, the examples for comparison 6 and 11 are cases of that the amounts of both a zinc ion and a free $F^-$ ion are large, the example for comparison 7 is a case of that the amount of a free $F^-$ ion is small, and the example for comparison 8 is a case of that the amount of a zinc ion is small. Also, the organic nitro compound which is contained in the example 12 is metanitrobenzenesulfonic acid.

(5) Water Rinsing

Using tap water, the rinsing was carried out at room temperature for 30 seconds.

(6) Deionized Water Rinsing

Using deionized water, the rinsing was carried out by dipping treatment at room temperature for 15 minutes.

COATING PROCESS (1) Under Coating

A cationic electrocoating paint made by Nippon Paint Co., Ltd. (OTO-E 1005) is coated so as to get a coating film of film thickness 30 μm and baked at 170° C. for 20 minutes.

(2) Intermediate Coating

An intermediate coating paint in a melamine-alkyd series made by Nippon Paint Co., Ltd. (Orga TO 4830) was coated by spraying and baked at 140° C. for 30 minutes, to get a coating film of film thickness 35 μm.

(3) Top Coating

A top coating paint in a melamine-alkyd series made by Nippon Paint Co., Ltd. (Orga TO 640) was coated by spraying and baked at 140° C. for 30 minutes, to get a coating film of film thickness 35 μm.

TABLE 1

| | Composition of phosphating solution (g/l) | | | | | | | | | Temperature for phosphating (°C.) |
|---|---|---|---|---|---|---|---|---|---|---|
| | Na | K | Mn | Ni | Zn | F | $NO_3$ | $NO_2$ | Organic nitro compound | |
| Example 1 | 5.0 | — | 0.6 | 1.0 | 1.2 | 0.3 | 4.0 | 0.06 | — | 40 |
| Example 2 | 5.0 | 1.0 | 0.5 | 0.5 | 1.2 | 0.3 | 4.0 | 0.06 | — | 40 |
| Example 3 | 8.0 | — | 0.6 | 1.0 | 2.0 | 0.6 | 8.0 | 0.1 | — | 25 |
| Example 4 | 5.0 | — | 0.6 | 1.0 | 0.8 | 0.2 | — | 0.04 | — | 50 |
| Example 5 | — | 5.0 | 0.6 | 1.0 | 1.2 | 0.3 | 4.0 | 0.06 | — | 40 |
| Example 6 | 2.0 | 2.0 | 0.6 | 1.0 | 0.6 | 0.15 | 4.0 | 0.03 | — | 60 |
| Example 7 | — | 5.0 | 1.0 | 0.3 | 1.0 | 0.3 | 4.0 | 0.06 | — | 40 |
| Example 8 | 5.0 | — | — | 2.0 | 1.0 | 0.3 | 4.0 | 0.06 | — | 40 |
| Example 9 | — | 5.0 | 1.0 | 2.5 | 1.0 | 0.3 | 4.0 | 0.06 | — | 40 |
| Example 10 | 10.0 | — | 0.6 | 1.0 | 1.2 | 0.5 | 4.0 | 0.06 | — | 40 |

TABLE 1-continued

| | Composition of phosphating solution (g/l) | | | | | | | | | Temperature for phosphating (°C.) |
|---|---|---|---|---|---|---|---|---|---|---|
| | Na | K | Mn | Ni | Zn | F | $NO_3$ | $NO_2$ | Organic nitro compound | |
| Example 11 | 8.0 | — | — | 2.0 | 1.5 | 0.5 | 4.0 | 0.07 | — | 35 |
| Example 12 | 5.0 | 1.0 | 0.5 | 1.0 | 1.2 | 0.4 | 4.0 | — | 0.5 | 40 |

TABLE 2

| | Composition of phosphating solution (g/l) | | | | | | | | Temperature for phosphating (°C.) |
|---|---|---|---|---|---|---|---|---|---|
| | Na | K | Mn | Ni | Zn | F | $NO_3$ | $NO_2$ | |
| Example for comparison 1 | 5.0 | — | 0.6 | 1.0 | 1.2 | — | 4.0 | 0.06 | 40 |
| Example for comparison 2 | 1.5 | 0.5 | 0.3 | 0.5 | 1.2 | 0.3 | 4.0 | 0.06 | 40 |
| Example for comparison 3 | 20.0 | — | 0.5 | 1.0 | 1.2 | 0.3 | 4.0 | 0.06 | 40 |
| Example for comparison 4 | 10.0 | — | 0.6 | 1.0 | 0.8 | 0.5 | — | 0.04 | 60 |
| Example for comparison 5 | — | 5.0 | 0.5 | — | 1.2 | 0.3 | 4.0 | 0.06 | 40 |
| Example for comparison 6 | 2.0 | 2.0 | 0.6 | 1.0 | 2.0 | 0.4 | 4.0 | 0.03 | 60 |
| Example for comparison 7 | — | 5.0 | 1.0 | 0.3 | 1.0 | 0.1 | 4.0 | 0.06 | 40 |
| Example for comparison 8 | 5.0 | — | — | 2.0 | 0.8 | 0.3 | 4.0 | 0.06 | 30 |
| Example for comparison 9 | — | 5.0 | 0.6 | 1.0 | 1.0 | 0.15 | 4.0 | 0.06 | 30 |
| Example for comparison 10 | 10.0 | — | 0.6 | 1.0 | 1.2 | 0.6 | 4.0 | 0.06 | 40 |
| Example for comparison 11 | 8.0 | — | 0.6 | 1.0 | 2.5 | 1.0 | 4.0 | 0.07 | 25 |
| Example for comparison 12 | 10.0 | 8.0 | 0.6 | 1.0 | 1.2 | 0.4 | 4.0 | 0.06 | 40 |

For the plates on which the phosphating and coating were carried out under the forementioned conditions, the outlook and weight of the coating film were measured and also, the adhesion test, filiform rust test, and saline spraying test were carried out to evaluate the coated surface. Results are shown in Tables 3 and 4. The evaluation was carried out on the surfaces of the aluminum alloy (Al), steel (Fe), and zinc-plated steep (Zn), respectively. In the tables the outlook of the coating film was shown in three ranks such as circles for good, as triangles for somewhat bad, and as crosses for bad.

(1) Adhesion Test

A plate coated was dipped in deionized water of 50° C. for 10 days, on which 100 checkerboard squares of 2 mm interval were made by a keen cutter and an adhesive tape was pressed, and the tape was peeled off in a manner vertical to the plate surface. Number of the checkerboard squares of coated film remaining on the plate was determined.

(2) Filiform Rust Test

A coated plate on which cutting was given was subjected to the saline spraying test (JIS-Z-2871) for 24 hours and then, a humidity cabinet test with 75 to 80% of relative humidity at 50° C. was carried out for 1000 hours. After the test, a length of filiform rust obtained from the cut part was determined. However, for the aluminum alloy surface among the metal surfaces, a whole length of filiform rust per 10 cm of the cut part was determined and for the steel and zinc-plated steel surfaces the maximum length on one side of the cut part was determined.

(3) Saline Spraying Test

A coated plate on which cross cutting was carried out was tested with use of a saline spray testing machine for 1000 hours according to said JIS-Z-2871, and a determination similar to said filiform rust test was carried out.

TABLE 3

| | Outlook of coating film | | | Weight of coating film ($g/m^2$) | | | Adhesion (pieces) | | | Filiform rust (mm) | | | Resistance for saline spraying (mm) | | |
|---|---|---|---|---|---|---|---|---|---|---|---|---|---|---|---|
| | Al | Fe | Zn | Al | Fe | Zn | Al | Fe | Zn | Al | Fe | Zn | Al | Fe | Zn |
| Example 1 | ○ | ○ | ○ | 1.5 | 2.4 | 2.8 | 100 | 100 | 100 | 2.5 | 1.5 | 0.8 | 0.8 | 1.0 | 1.5 |
| Example 2 | ○ | ○ | ○ | 1.5 | 2.6 | 2.9 | 100 | 100 | 100 | 3.5 | 1.8 | 0.5 | 0.5 | 1.0 | 1.2 |
| Example 3 | ○ | ○ | ○ | 1.4 | 2.6 | 2.7 | 100 | 100 | 100 | 1.0 | 1.9 | 0.5 | 0.6 | 1.2 | 1.5 |
| Example 4 | ○ | ○ | ○ | 1.7 | 2.5 | 2.9 | 100 | 100 | 100 | 2.0 | 2.0 | 0.5 | 0.5 | 1.0 | 1.5 |
| Example 5 | ○ | ○ | ○ | 1.6 | 2.5 | 2.8 | 100 | 100 | 100 | 1.5 | 1.8 | 0.5 | 0.7 | 1.5 | 1.8 |
| Example 6 | ○ | ○ | ○ | 2.0 | 2.7 | 2.9 | 100 | 100 | 100 | 3.0 | 2.0 | 0.5 | 0.8 | 1.0 | 1.6 |
| Example 7 | ○ | ○ | ○ | 1.5 | 2.8 | 2.9 | 100 | 100 | 100 | 2.0 | 1.8 | 0.5 | 0.5 | 1.5 | 1.5 |
| Example 8 | ○ | ○ | ○ | 1.5 | 2.6 | 2.9 | 100 | 100 | 100 | 2.5 | 1.6 | 0.6 | 0.4 | 1.4 | 1.6 |
| Example 9 | ○ | ○ | ○ | 1.4 | 2.3 | 2.5 | 100 | 100 | 100 | 3.0 | 1.7 | 0.5 | 0.6 | 1.6 | 1.5 |
| Example 10 | ○ | ○ | ○ | 1.7 | 2.6 | 2.9 | 100 | 100 | 100 | 1.5 | 2.1 | 0.5 | 0.5 | 1.4 | 1.2 |
| Example 11 | ○ | ○ | ○ | 1.8 | 2.4 | 2.7 | 100 | 100 | 100 | 2.5 | 1.8 | 0.4 | 0.5 | 1.8 | 1.0 |
| Example 12 | ○ | ○ | ○ | 1.6 | 2.6 | 2.8 | 100 | 100 | 100 | 0.5 | 2.0 | 0.5 | 0.6 | 1.2 | 1.0 |

TABLE 4

| | Outlook of coating film | | | Weight of coating film ($g/m^2$) | | | Adhesion (pieces) | | | Filiform rust (mm) | | | Resistance for saline spraying (mm) | | |
|---|---|---|---|---|---|---|---|---|---|---|---|---|---|---|---|
| | Al | Fe | Zn | Al | Fe | Zn | Al | Fe | Zn | Al | Fe | Zn | Al | Fe | Zn |
| Example for comparison 1 | X | ○ | ○ | 0.1 | 2.8 | 2.4 | 90 | 95 | 100 | 10.0 | 2.5 | 0.5 | 1.0 | 2.0 | 1.5 |
| Example for comparison 2 | ○ | ○ | ○ | 1.6 | 2.4 | 2.5 | 70 | 95 | 60 | 3.0 | 2.8 | 0.5 | 0.8 | 1.2 | 1.5 |

TABLE 4-continued

| | Outlook of coating film | | | Weight of coating film ($g/m^2$) | | | Adhesion (pieces) | | | Filiform rust (mm) | | | Resistance for saline spraying (mm) | | |
|---|---|---|---|---|---|---|---|---|---|---|---|---|---|---|---|
| | Al | Fe | Zn | Al | Fe | Zn | Al | Fe | Zn | Al | Fe | Zn | Al | Fe | Zn |
| Example for comparison 3 | Δ | Δ | ○ | 0.8 | 1.2 | 2.2 | 70 | 90 | 100 | 7.5 | 4.5 | 0.5 | 0.5 | 2.5 | 1.8 |
| Example for comparison 4 | ○ | ○ | ○ | 2.5 | 2.8 | 3.0 | 30 | 100 | 100 | 1.0 | 1.8 | 0.8 | 2.0 | 1.0 | 1.5 |
| Example for comparison 5 | ○ | ○ | ○ | 1.3 | 2.6 | 2.9 | 40 | 90 | 15 | 2.5 | 3.0 | 0.5 | 0.8 | 2.0 | 2.5 |
| Example for comparison 6 | ○ | ○ | ○ | 2.0 | 2.9 | 3.5 | 45 | 70 | 100 | 3.0 | 4.0 | 0.6 | 2.0 | 3.0 | 2.0 |
| Example for comparison 7 | X | ○ | ○ | 0.5 | 2.6 | 2.8 | 98 | 100 | 100 | 4.5 | 2.0 | 0.5 | 1.2 | 1.5 | 1.6 |
| Example for comparison 8 | ○ | Δ | ○ | 1.2 | 1.8 | 2.4 | 100 | 100 | 100 | 1.6 | 4.1 | 0.8 | 0.6 | 4.2 | 1.2 |
| Example for comparison 9 | X | ○ | ○ | 0.3 | 2.5 | 2.7 | 95 | 100 | 100 | 5.3 | 2.0 | 0.5 | 2.4 | 1.8 | 2.2 |
| Example for comparison 10 | Δ | ○ | ○ | 1.6 | 2.4 | 2.8 | 80 | 100 | 100 | 1.8 | 1.6 | 0.8 | 2.5 | 1.2 | 1.8 |
| Example for comparison 11 | ○ | ○ | ○ | 1.5 | 2.9 | 3.0 | 50 | 60 | 80 | 3.8 | 2.6 | 0.6 | 3.5 | 2.6 | 2.0 |
| Example for comparison 12 | Δ | Δ | ○ | 0.8 | 1.2 | 2.6 | 70 | 90 | 100 | 5.2 | 4.6 | 0.5 | 0.6 | 4.0 | 1.8 |

As seen from said test results, in the examples of the present invention the coating finish and paint film performance are all superior, whereas in the examples for comparison deviating from the phosphating conditions of the present invention the coating finish or coating performance is bad in any part of steel, zinc-plated steel, or an aluminum alloy.

What is claimed is:

1. A method for phosphating metal surfaces, which comprises treating a structure having a first metal surface of an aluminum alloy and a second metal surface of steel and/or zinc-plated steel with an aqueous phosphate solution before cationic electrocoating, being characterized by that said first metal surface and said second metal surface are brought, to form a coating film with conversion, in contact with said aqueous phosphate solution which is satisfactory for the following four conditions, (a) $2.0 \leqq$ Na ion + K ion $\leqq 15.0$ (g/l)

a total concentration of a sodium ion and a potassium ion is in a range of 2.0 to 15.0 (g/l), (b) $1.0 \leqq$ Mn ion + Ni ion $\leqq 5.0$ (g/l)

a total concentration of manganese ion and a nickel ion is in a range of 1.0 to 5.0 (g/l), (c) $1.6-0.02\ T \leqq$ Zn ion $\leqq 2.5-0.02\ T$ (g/l)

a concentration of a zinc ion is in a range of $(1.6-0.02\ T)$ to $(2.5-0.02\ T)$ (g/l), (d) $8.0\ T^{-1} \leqq$ free $F^-$ ion $\leqq 20.0\ T^{-1}$ (g/l)

a concentration of a free $F^-$ ion is in a range of $8.0\ T^{-1}$ to $20.0\ T^{-1}$ (g/l), wherein, T is a temperature (°C.) of said aqueous phosphate solution and $20 \leqq T \leqq 60$.

2. A method for phosphating metal surfaces as claimed in claim 1, wherein a supplying source of the free $F^-$ ion is a member selected from a group consisting of hydrofluoric acid, potassium fluoride, sodium fluoride, acid potassium fluoride, acid sodium fluoride, ammonium fluoride, and acid ammonium fluoride.

3. A method for phosphating metal surfaces as claimed in claim 1, wherein to the aqueous phosphate solution was added an accelerator selected from a group consisting of a nitrite ion, a nitrate ion, a nitrobenzenesulfonate ion, a chlorate ion, and hydrogen peroxide for forming a conversion coating film.

4. A method for phosphating metal surfaces as claimed in any one of claims 1, 2, and 3, wherein the contact of said first and second metal surfaces with the aqueous phosphate solution includes the steps of a dipping treatment for 15 or more seconds subsequently followed by a spraying treatment for 2 or more seconds.

* * * * *

UNITED STATES PATENT AND TRADEMARK OFFICE

CERTIFICATE OF CORRECTION

PATENT NO. : 5,258,079

DATED : November 2, 1993

INVENTOR(S) : Mikio NAKATSUKASA et al

It is certified that error appears in the above-indentified patent and that said Letters Patent is hereby corrected as shown below:

On the title page, item [73] should read as follows:

--[73] Assignee: Mazda Motor Corporation, Hiroshima, Japan; Nippon Paint Co., Ltd., Osaka, Japan--

Signed and Sealed this

Tenth Day of September, 1996

Bruce Lehman

*Attest:*

BRUCE LEHMAN

*Attesting Officer*

*Commissioner of Patents and Trademarks*